US006181305B1

(12) United States Patent
Nguyen et al.

(10) Patent No.: US 6,181,305 B1
(45) Date of Patent: Jan. 30, 2001

(54) METHOD FOR DRIVING AN AC TYPE SURFACE DISCHARGE PLASMA DISPLAY PANEL

(75) Inventors: Nhan Thanh Nguyen; Akira Otsuka, both of Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 08/841,607

(22) Filed: Apr. 30, 1997

(30) Foreign Application Priority Data

Nov. 11, 1996 (JP) ..... 8-298736

(51) Int. Cl.[7] ..... G09G 3/28

(52) U.S. Cl. ..... 345/60; 345/66; 345/67; 315/169.4

(58) Field of Search ..... 345/60, 66, 67, 345/68, 208; 315/169.4, 169.3

(56) References Cited

U.S. PATENT DOCUMENTS

| | | | | |
|---|---|---|---|---|
| 4,328,489 | * | 5/1982 | Ngo | 345/60 |
| 4,684,849 | * | 8/1987 | Otsuka et al. | 315/169.4 |
| 4,833,463 | * | 5/1989 | Dick et al. | 345/67 |
| 5,162,701 | * | 11/1992 | Sano et al. | 315/169.4 |
| 5,446,344 | * | 8/1995 | Kanazawa | 315/169.4 |
| 5,742,265 | * | 4/1998 | Stoller et al. | 345/60 |

FOREIGN PATENT DOCUMENTS 0 549 275 6/1993 (EP) .

OTHER PUBLICATIONS

"Erase Depolarizer", IBM Technical Disclosure Bulletin, vol. 28, No. 2, Jul. 1985, pgs. 531–533.
"Precise State Control of AC Gas–Discharge Dispalys", IEEE Transactions on Electron Devices, vol. ED–24, No. 8, Aug. 1978.
"Slope Controlled Self–Coniditioning Waveform", IBM TEchnical Disclosure Bulletin, vol. 25, No. 7a, Dec. 1982.

* cited by examiner

*Primary Examiner*—Dennis-Doon Chow
*Assistant Examiner*—Amr Awad
(74) *Attorney, Agent, or Firm*—Staas & Halsey LLP

(57) ABSTRACT

A method of driving an AC type PDP according to the present invention includes a full screen write step of applying a write voltage higher than a discharge starting voltage to respective cells constituting a screen of the PDP to cause a discharge in the respective cells for accumulation of wall charges therein, the method comprising a write preparation step of applying to the respective cells an auxiliary write voltage lower than the discharge starting voltage and having the same polarity as that of the write voltage to cause a discharge in a charged cell having wall charges accumulated before the application of the auxiliary write voltage for inversion of the polarity of a wall voltage in the charged cell, the write preparation step being performed prior to the full screen write step, wherein the application of the write voltage in the full screen write step is performed within a period during which space charges resulting from the discharge caused in response to the application of the auxiliary write voltage remains in the charged cell.

8 Claims, 9 Drawing Sheets

METHOD FOR DRIVING AN AC TYPE SURFACE DISCHARGE PLASMA DISPLAY PANEL

BACKGROUND OF THE INVENTION

1. Field of the Invention

The present invention relates to a method of driving an AC type plasma display panel (an AC type PDP).

2. Description of Related Art

In recent years, PDPs have found widespread application in the fields of TV displays and computer monitors because of their superiority over liquid crystal devices in dynamic image display and their capability of color display. The PDPs have also received attention as large screen flat panel display devices for high definition TV. For higher quality display, considerable research and development have been directed toward a method of driving a PDP.

In a matrix display type PDP having a screen composed of a set of cells as display elements, a memory function is used to sustain the ON state of a cell. For example, an AC type PDP is structurally imparted with a memory function with pairs of primary electrodes covered with a dielectric layer. During displaying on a PDP of this type, the screen is subjected to progressive scanning for addressing thereby to produce charged states in cells in accordance with display data. Subsequently, a sustain voltage of alternating polarity is applied to the respective cells. In a write address mode, for example, a voltage for causing an address discharge is selectively applied to cells on each line during an addressing period to charge dielectric layers in specific cells. Each time the sustain voltage is applied during a sustain period, a discharge occurs only in cells having predetermined wall charges at the initiation of the sustain period. This is because the sustain voltage (i.e., the peak value of a sustain pulse) is adjusted to be lower than a discharge starting voltage so that an effective voltage (cell voltage) exceeds the discharge starting voltage only in the cells to which a voltage (wall voltage) resulting from the wall charges is applied in addition to the sustain voltage. If the sustain voltage is applied in a shorter cycle, seemingly continuous light emission (ON state) is obtained. Therefore, luminance is dependent on the length of the sustain period, if the sustain voltage has a constant frequency.

Normally, display data are periodically updated. In displaying television images, for example, addressing is performed K×k (K: the number of frames, k: the number of fields for multi-level gradation display) times per second. For the updating of the display data, charges in the respective cells should be equalized prior to the production of newly charged states to prevent the influence of the previous display. The equalization of the charges is achieved by a full screen write operation whereby a reset pulse (write voltage) with a peak value higher than the discharge starting voltage is applied at one time to all of the cells. A discharge occurs on the leading edge of the reset pulse so that greater wall charges are accumulated in the dielectric layer in each of the cells than during the sustain period. The wall voltage resulting from the accumulated wall charges cancels out the write voltage to reduce the effective voltage, resulting in a lower discharge magnitude. Thereafter, a so-called self-discharge is caused solely by the wall voltage at the completion of the application of the write voltage (on the trailing edge of the reset pulse), so that most of the wall charges disappear through neutralization. As a result, the dielectric layers over the entire screen are brought into a substantially uncharged state.

The full screen write operation mentioned above is performed to obtain a state in which the entire screen is equally charged. However, a conventional PDP has such a problem that a difference is produced in the discharge intensity between a cell with residual wall charges and a cell with substantially no residual charge on the application of the write voltage, resulting in unequal charging of the screen. More specifically, on each updating of display data, a cell put in a non-emission mode at the previous updating (referred to as "uncharged cell") is in a substantially uncharged state, while a cell put in an emission mode (referred to as "charged cell") has residual wall charges. As a result, the effective voltage in the charged cell is increased by the wall voltage added to the write voltage, so that a more intense discharge occurs in the charged cell than in the uncharged cell, increasing the charges in the charged cell. When the polarity of the write voltage is inverted, the effective voltage becomes lower than the write voltage by the magnitude of the wall voltage so that the discharge intensity in the charged cell becomes lower than that in the uncharged cell.

FIG. 10 is a graphical representation illustrating a difference in the luminous intensity between a charged cell and an uncharged cell in the conventional PDP, in which the abscissa represents the time elapsed from the application of the write voltage (leading edge of the applied pulse). As shown in FIG. 10, the peak value of the luminous intensity in the charged cell (solid line) is about seven times that of the luminous intensity in the uncharged cell (dashed line). Since the luminous intensity increases with an increase in the discharge intensity, it will be appreciated from FIG. 10 that the discharge intensity in the charged cell is much greater than that in the uncharged cell.

If the discharge intensity is excessively high in the full screen write operation, the charged area in the cell is expanded more than required, so that the wall charges will not completely disappear even if a self-discharge thereafter occurs. Conversely, if the discharge intensity is excessively low, the self-discharge will not occur due to insufficient charges with the wall charges remaining as they are. Where a driving sequence in the write address mode is employed in which addressing is performed after the whole screen is brought into the uncharged state by the self-discharge, it is necessary to accumulate proper and equal wall charges in each of the cells by the full screen write operation to ensure reliable addressing. Where a driving sequence in an erase address mode is employed in which wall charges are selectively removed by an address discharge, it is also necessary to accumulate proper and equal wall charges in each of the cells.

The removal of the wall charges may otherwise be achieved by selectively applying a driving voltage only to the charged cells, instead of applying the write voltage to each of the cells to cause an erase discharge. However, a variation in the accumulated charges makes it difficult to remove the wall charges without depending on the self-discharge. Moreover, the time required for the scanning of the screen is doubled because displaying one image requires two-step addressing for writing and erasing the image. This hinders dynamic image display with natural and smooth movements and multi-level gradation display. Hence, the PDP indispensably requires the full screen write operation in practical application thereof.

SUMMARY OF THE INVENTION

It is therefore an object of the present invention to allow for high quality display free from unevenness by equally charging all cells in a full screen write process, whether or not wall charges remain in the cells.

In the present invention, residual wall charges are utilized to cause a discharge only in charged cells, and wall charges are newly accumulated therein. The polarity of the wall voltage in the cells is inverted by the discharge. Within a period of about 20 μs during which sufficient floating charges (space charges) are present in a discharge space, a write voltage is applied to the charged cells and uncharged cells. The polarity of the write voltage is determined such that the wall voltage having the inverted polarity lowers an effective voltage. In the uncharged cells, the effective voltage is equal to the write voltage, so that a discharge occurs at a predetermined intensity. In the charged cells, the effective voltage is lower than the write voltage, but a discharge starting voltage is lowered by a priming effect exerted by the space charges. The decrement of the effective voltage is canceled out by the priming effect, so that a discharge occurs at an intensity substantially equivalent to that of the discharge caused in the uncharged cells. By optimizing the conditions for voltage application, the discharge intensities in the charged cells and the uncharged cells can be equalized and, hence, the charged cells and the uncharged cells can be equally charged.

In accordance with the present invention, there is provided a method of driving an AC type PDP including a full screen write step of applying a write voltage higher than a discharge starting voltage to respective cells constituting a screen of the PDP to cause a discharge in the respective cells for accumulation of wall charges therein, the method comprising a write preparation step of applying to the respective cells an auxiliary write voltage lower than the discharge starting voltage and having the same polarity as that of the write voltage to cause a discharge in a charged cell having wall charges accumulated before the application of the auxiliary write voltage for inversion of the polarity of a wall voltage in the charged cell, the write preparation step being performed prior to the full screen write step, wherein the application of the write voltage in the full screen write step is performed within a period during which space charges resulting from the discharge caused in response to the application of the auxiliary write voltage remain in the charged cell.

The foregoing and other objects, features and advantages of the present invention will become apparent from the following description with reference to the attached drawings.

DESCRIPTION OF THE PREFERRED EMBODIMENTS

In accordance with a second aspect of the present invention, it provides a method of driving an AC type PDP, wherein, in the case where the AC type PDP is a three-electrode surface discharge AC type PDP, the driving method comprises: a reset step of causing a self-discharge in respective cells constituting a screen of the PDP for equalization of charged states in the respective cells over the screen; an addressing step of accumulating wall charges in a specific cell in accordance with display data; and a sustaining step of applying a sustain pulse having a peak value lower than that of a discharge starting voltage to sustain the display data; the reset step, the addressing step and the sustaining step being repeatedly performed, wherein the reset step comprises the steps of: applying an auxiliary write voltage lower than the discharge starting voltage to the respective cells to cause a discharge in a charged cell having wall charges accumulated before the application of the auxiliary write voltage for inversion of the polarity of a wall voltage in the charged cell; and applying to the respective cells a write voltage higher than the discharge starting voltage and having the same polarity as that of the auxiliary write voltage within a period during which space charges resulting from the discharge caused in response to the application of the auxiliary write voltage remain in the charged cell thereby to cause a discharge in the respective cells for accumulation of wall charges required for the self-discharge in the respective cells.

In accordance with a third aspect of the present invention, a time interval between the application of the auxiliary write voltage and the application of the write voltage is 10 μs to 20 μs.

In accordance with a fourth aspect of the present invention, a voltage pulse having the same peak value as that of the sustain pulse and a pulse width smaller than that of the sustain pulse is applied as the auxiliary write voltage.

In accordance with a fifth aspect of the present invention, a voltage pulse having a peak value lower than that of the sustain pulse and a pulse width greater than that of the sustain pulse is applied as the auxiliary write voltage.

In accordance with a sixth aspect of the present invention, a voltage pulse having a pulse width greater than that of the sustain pulse and an obtuse waveform having a less steep rising edge is applied as the auxiliary write voltage.

Embodiments of the present invention will now be described by way of example, with reference to the accompanying drawings, which do not limit the scope of the present invention.

Figure 1A:
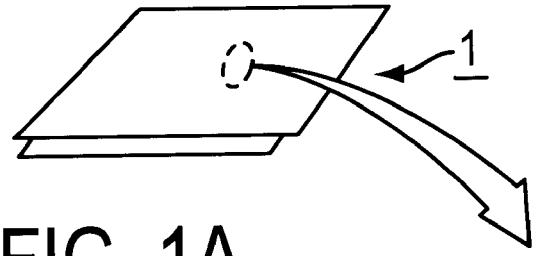
FIG. 1A and FIG. 1B are a perspective view illustrating the internal construction of a PDP according to the present invention.
Figure 1B:
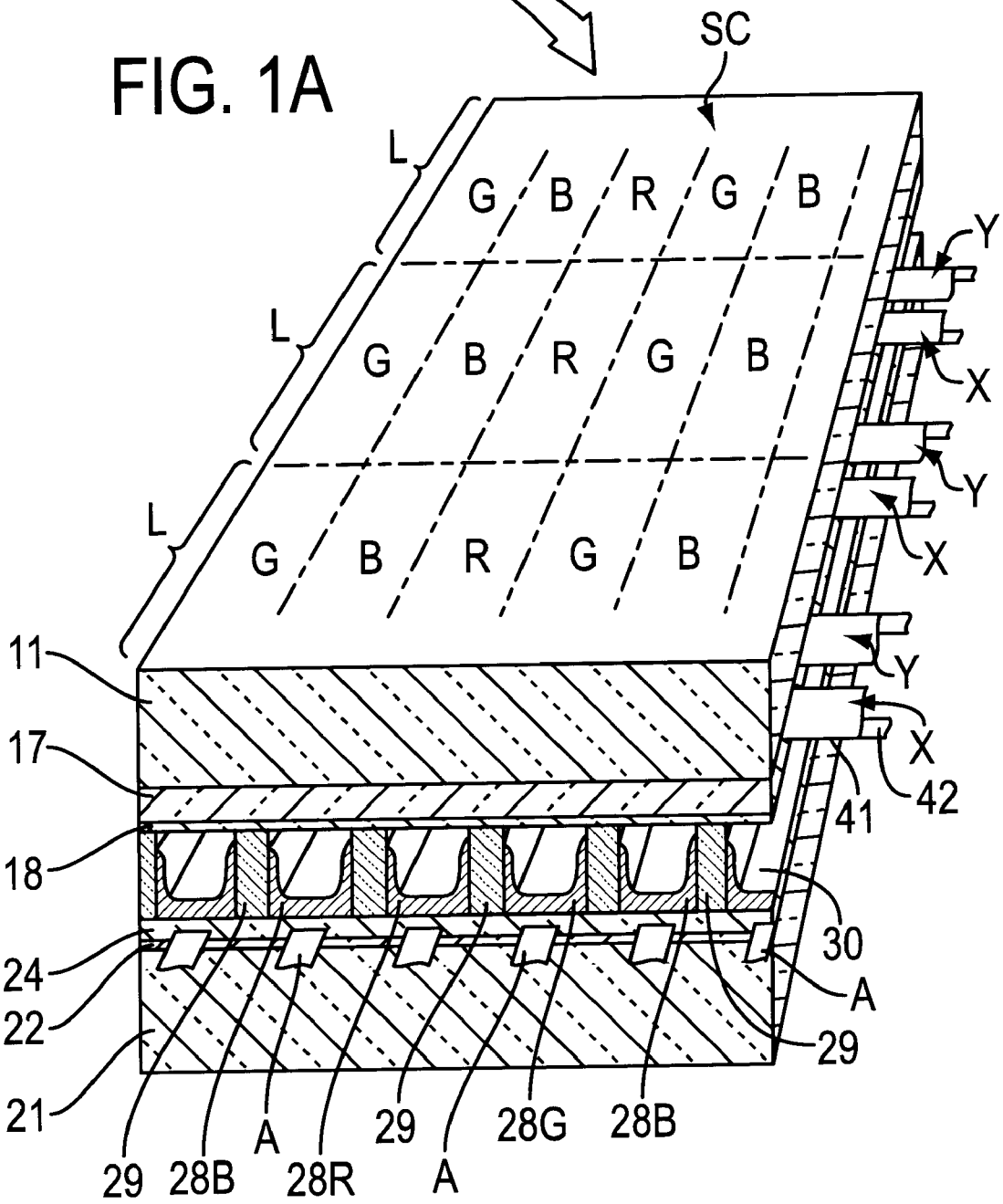

FIG. 1A and 1B are a perspective view illustrating the internal construction of an exemplary PDP according to the present invention.

The PDP 1 is a three-electrode surface discharge AC type PDP. A pair of sustain electrodes X and Y are provided for each matrix display line L on an interior surface of a front glass substrate 11. The sustain electrodes X and Y each include a transparent conductive film 41 and a metal film 42, and are covered with a dielectric layer 17 for AC driving. The surface of the dielectric layer 17 is covered with a protective film 18 formed of MgO by vapor deposition. Provided on an interior surface of a rear glass substrate 21 are an underlying layer 22, address electrodes A for row selection, an insulating layer 24, barrier ribs 29 for defining cells, and fluorescent layers 28R, 28G and 28B of three colors (R, G, B) for color display. The barrier ribs 29 each have a linear configuration in plan. These barrier ribs 29 partition a discharge space 30 across lines on a subpixel basis, and define the discharge space 30 as having a predetermined gap (e.g., 150 $\mu$m). The discharge space 30 is filled with Penning gas comprised of a mixture of neon and xenon. Each pixel (picture element) for display comprises three subpixels arranged along a line. Since the barrier ribs 29 are arranged in a stripe pattern, the subpixels in each row in the discharge space 30 are arranged in sequence across all the lines L. The subpixels in each row are adapted to emit the same color light. A structure within each subpixel constitutes one cell (display element). A screen SC is comprised of a cluster of cells. Exemplary specifications for the screen SC are shown in Table 1.

TABLE 1

| | Specification |
|---|---|
| Screen size | 42 inches |
| Aspect ratio | 16:9 |
| Number of pixels | 852 × 480 |
| Number of subpixels | 2556 × 480 |
| Pixel pitch | 1.08 mm |
| Arrangement of subpixels | R G B R G B |

In the PDP 1, the address electrodes A and the sustain electrodes Y are used for activation and inactivation of each subpixel for light emission (addressing to each pixel). More specifically, screen scanning (line selection) is achieved by sequentially applying a scan pulse to m sustain electrodes Y (m: the number of the lines), and a predetermined charged state is established for each line L by opposed discharge between a sustain electrode Y and an address electrode A selected according to display data. The sustain electrodes X may preliminarily be connected in common by a connection electrode on the substrate in the fabrication process. Alternatively, the sustain electrodes may be connected in common by a flexible external connection cable and connected to an external driving circuit. When a sustain pulse having a predetermined peak value (Vs) is applied alternately to the sustain electrodes X and Y after addressing, a surface discharge (sustain discharge) occurs on the surface of the substrate in a cell having predetermined wall charges at the completion of addressing. During the opposed discharge, the charges move perpendicular to the pair of opposed substrates. During the surface discharge, the charges move along the surface of the front substrate. The fluorescent layer 28R, 28G or 28B is locally excited by ultraviolet rays resulting from the surface discharge to emit visible light. A portion of the visible light transmitted by the glass substrate 11 serves for display. A method of driving the PDP 1 will hereinafter be described in detail.

Figure 2:
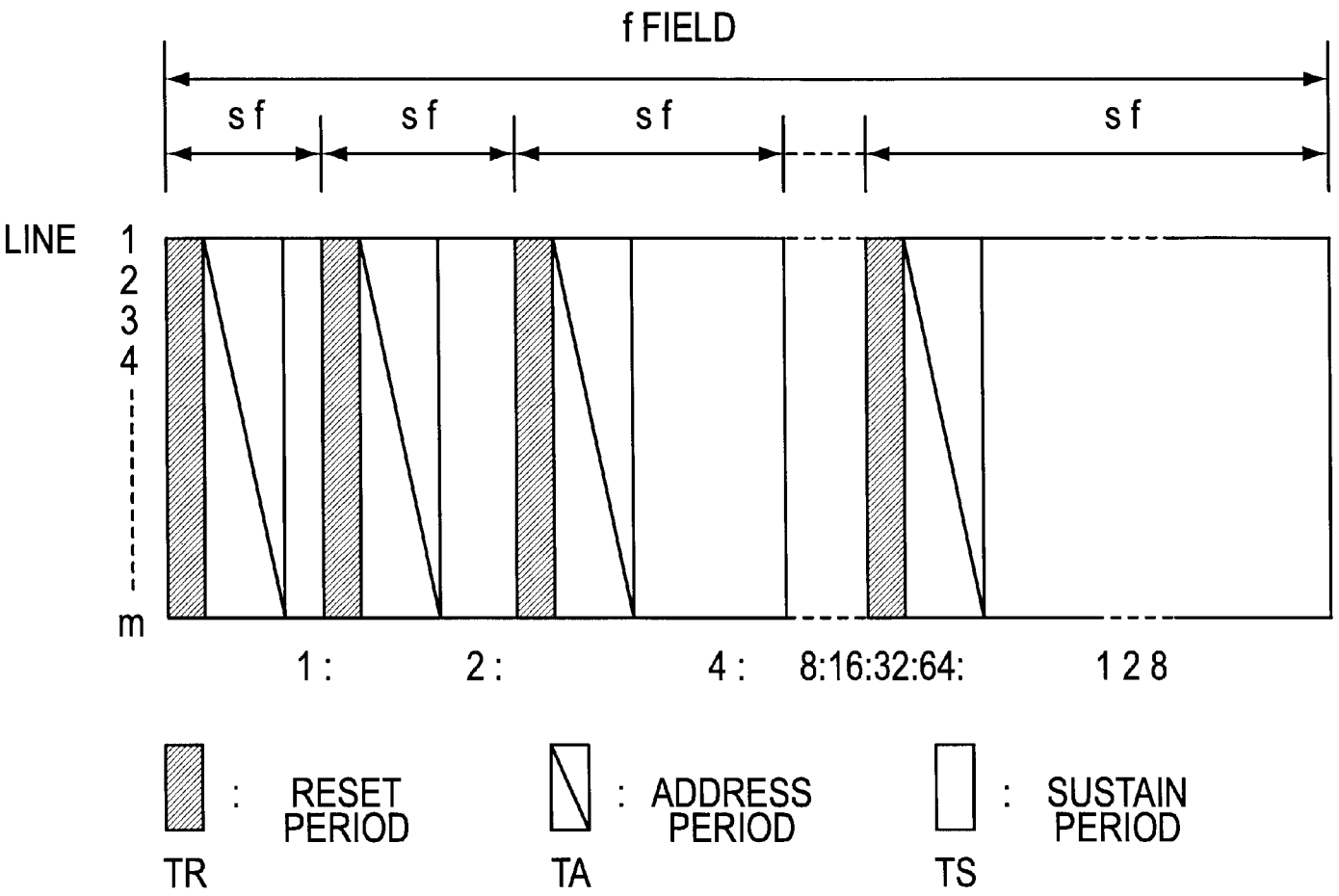
FIG. 2 is a diagram illustrating a field arrangement.

FIG. 2 is a diagram illustrating a field arrangement. It is herein assumed that an image is to be reproduced by interlaced scanning whereby one frame is divided into a plurality of fields like TV image reproduction.

Where an image is displayed on a 256-level gradation scale, one field f is divided into eight subfields sf1, sf2, sf3, . . . sf8 (hereinafter generally referred to as subfields sf with no distinction). The display period for each of the subfields sf is comprised of a reset period TR, an address period TA and a sustain period TS. The number of times of light emission during the sustain period TS is determined for each of the subfields sf by weighting so that the ratio of luminances in the respective subfields sf is 1:2:4:8 16:32:64:128. The subfields each give an image on one gradation level. The subfields need not be arranged in increasing (decreasing) order of weights. For example, an optimization method is known wherein subfields with larger weights are arranged in the middle of the field.

Figure 3:
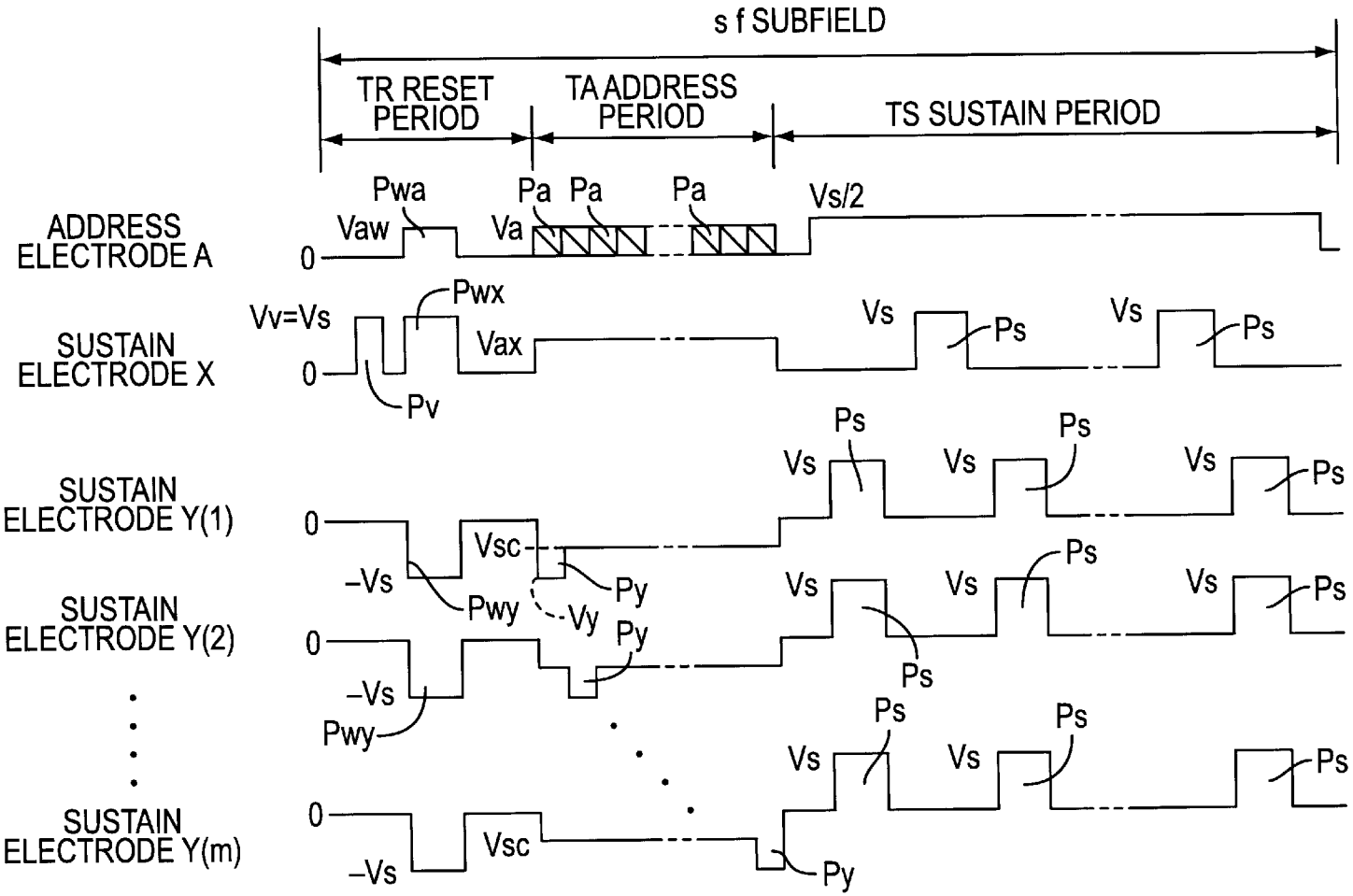
FIG. 3 is a voltage waveform chart for a driving method in accordance with a first embodiment.

FIG. 3 is a voltage waveform chart for a driving method in accordance with a first embodiment.

During the reset period TR in the display period for each of the subfields sf, the whole screen is brought into the uncharged state to prevent the influence of the previous ON state. During the reset period TR, a drive control unique to the present invention is performed. Briefly, a write preparation process for causing a discharge only in charged cells is performed prior to a full screen write process for accumulating wall charges required for a self-discharge. More specifically, a positive auxiliary write pulse Pv with a peak value Vv lower than a surface discharge starting voltage (e.g., 170 V) is applied to the sustain electrodes X. Thereafter, the full screen write process is performed in a period of about 20 $\mu$s during which space charges resulting from the discharge caused by the application of the auxiliary write pulse Pv remain in a sufficient quantity. To adjust a relative driving voltage (bias potential difference Vw) between the sustain electrodes X and Y to be sufficiently higher than the surface discharge starting voltage, a positive write pulse Pwx with a peak value Vs is applied to the sustain electrodes X and, at the same time, a negative write pulse Pwy with a peak value Vs is applied to the sustain electrodes Y in the full screen write process according to the present embodiment. To cause an opposed discharge for triggering a surface discharge, a positive write pulse Pwa with a peak value Vaw (e.g., 60 V) is applied to the address electrodes A. The effects of the reset process including the write preparation process and the full screen write process will be described later.

During the address period TA, progressive line addressing is performed. The sustain electrodes X are each biased to a positive potential Vax (e.g., 55 V) relative to the ground potential, while the sustain electrodes Y are each biased to a negative potential Vsc (e.g., −70 V). With the sustain electrodes X and Y thus biased, the lines are selected one by one from the first line, and a negative scan pulse Py is applied to a sustain electrode Y on each selected line. Thus, the sustain electrode Y on the selected line is temporarily biased to a negative potential Vy (e.g., −170 V). Simultaneously with the line selection, a positive address pulse Pa with a peak value Va (e.g., 60 V) is applied to the address electrodes A corresponding to the cells to be activated for light emission. An address discharge occurs between the sustain electrode Y and the address electrode A in the cell on the selected line to which the address pulse Pa is applied. Since the sustain electrode X is biased to a potential having the same polarity as that of the address pulse Pa, the address pulse Pa is canceled out by the biasing so that no discharge occurs between the sustain electrode X and the address electrode A. Moreover, since the bias potential Vax at the sustain electrode X prevents the charging of the non-selected cells on the line, the relative voltage between the sustain electrodes X and Y is controlled to be lower than the surface discharge starting voltage $Vf_{xy}$.

During the sustain period TS, the luminous state of the cells activated by the addressing is sustained so that the cells can each maintain a proper luminance depending on the gradation level. To prevent an opposed discharge, the address electrodes A are each biased to a positive potential (e.g., Vs/2), and a positive sustain pulse Ps with a peak value Vs is initially applied to each of the sustain electrodes Y. Thereafter, a sustain pulse Ps is applied alternately to the sustain electrodes X and Y. Upon each application of the sustain pulse Ps, a surface discharge occurs in the cells charged during the address period TA, so that the polarity of the wall voltage is inverted. The last sustain pulse Ps is applied to the sustain electrode Y.

Figure 4A:
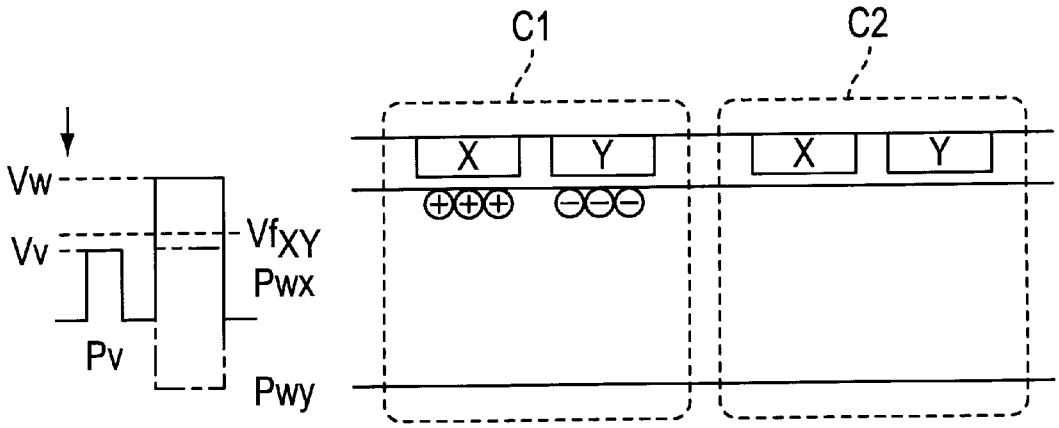
FIGS. 4A to 4C are diagrams illustrating changes in the charged state in a write preparation process.
Figure 4B:
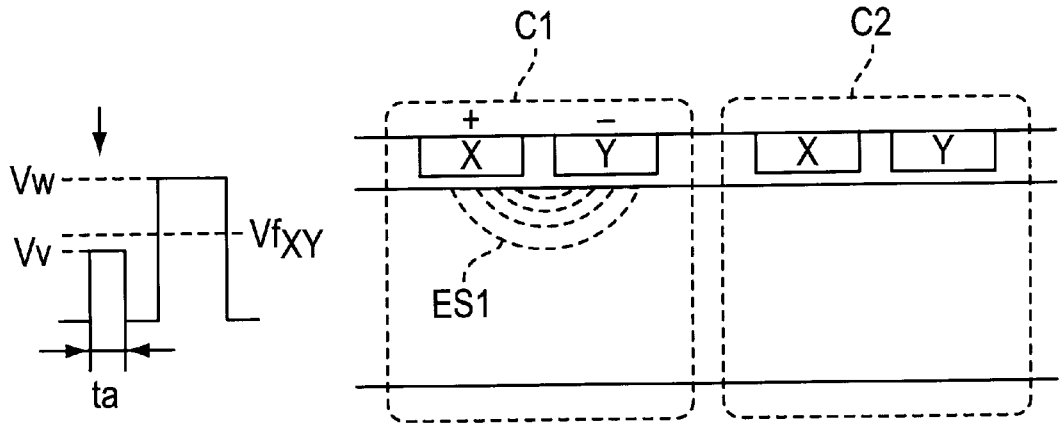
Figure 4C:
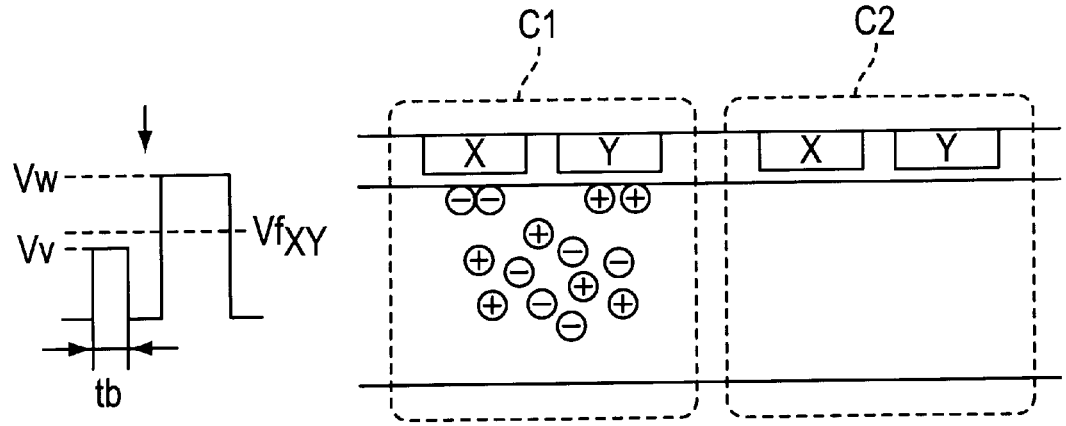

FIGS. 4A to 4C are diagrams illustrating changes in the charged state during the write preparation process.

As shown in FIG. 4A, immediately before the application of the auxiliary write voltage Vv, wall charges exist in a charged cell C1 which emitted light during the sustain period of the previous subfield, while substantially no charge exists in an uncharged cell C2. In the charged cell C1, a positive wall charge is present on the side of the sustain electrode X, while a negative wall charge is present on the side of the sustain electrode Y. If the potential at the sustain electrode Y is assumed to be a reference potential, the wall voltage is positive.

When the auxiliary write voltage Vv is applied to each of the cells without distinction between the charged cell Cl and the uncharged cell C2, the surface discharge ES1 occurs only in the charged cell C1 as shown in FIG. 4B. This is because the auxiliary write voltage Vv is lower than the surface discharge staring voltage $Vf_{xy}$. In this manner, the discharge occurs selectively and spontaneously in the charged cell such as during the sustain period. Wall charges newly accumulated by the surface discharge ES1 are dependent on the period (pulse width) ta during which the auxiliary write voltage Vv is applied. The application period (pulse width) ta is 1 $\mu$s to 3 $\mu$s in practice. Where the auxiliary write voltage Vv is adjusted to be equal to the sustain voltage Vs, the construction of the driving circuit can be simplified with a common power source. When Vv=Vs is satisfied, the pulse width ta is adjusted to be shorter than the width of the sustain pulse Ps.

The polarity of the wall voltage in the charged cell C1 is inverted by the surface discharge ES1. More specifically, a negative charge is accumulated on the side of the sustain electrode X, while a positive charge is accumulated on the side of the sustain electrode Y, as shown in FIG. 4C. If the time elapsed from the completion of the surface discharge ES1 is about 20 $\mu$s or less, sufficient space charges remain in the charged cell C1.

Figure 5A:
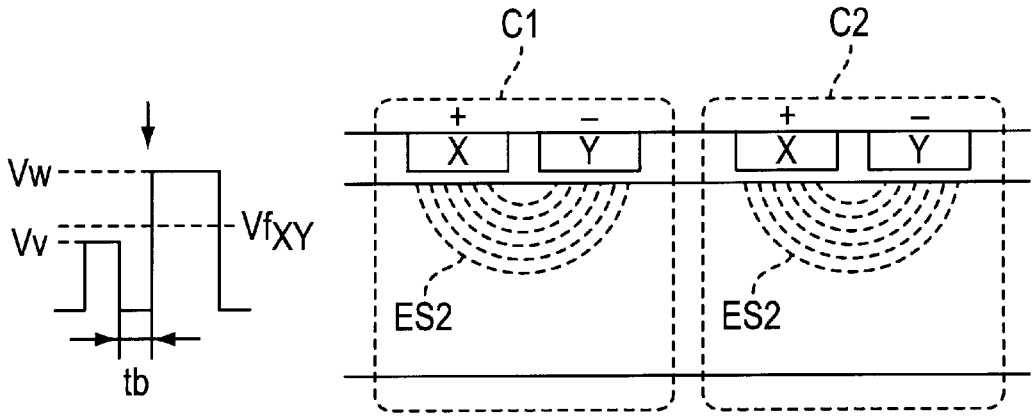
FIGS. 5A to 5C are diagrams illustrating changes in the charged state in a full screen write process.
Figure 5B:
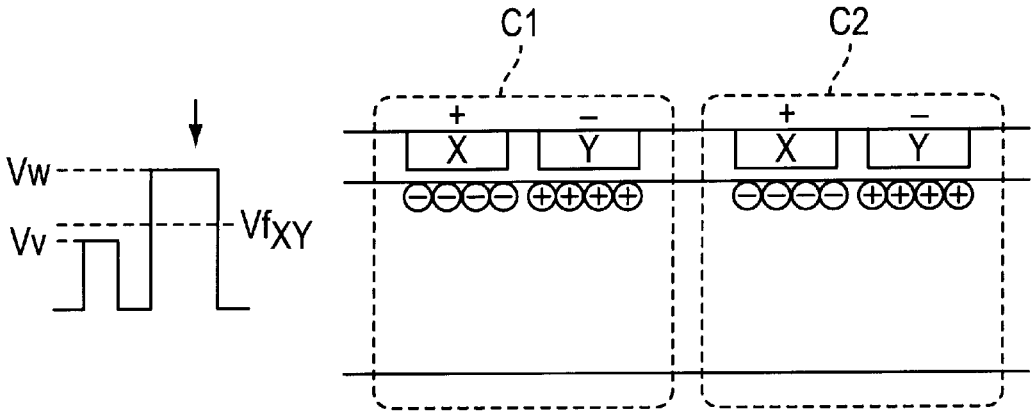
Figure 5C:
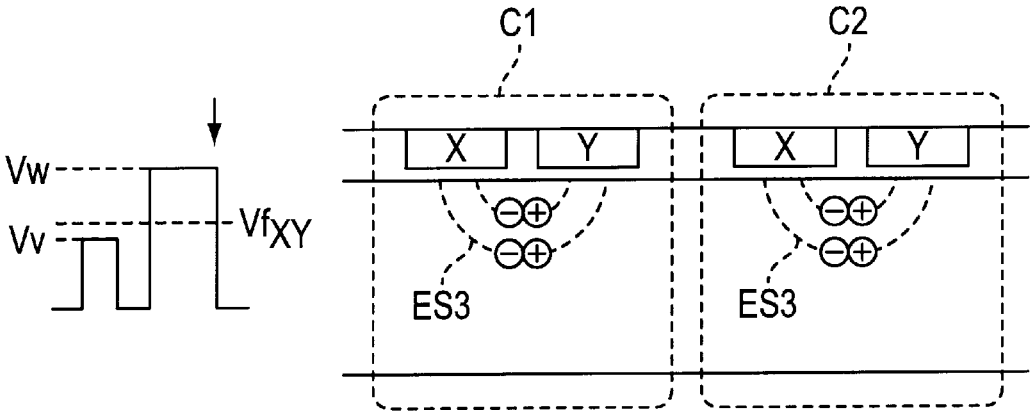

FIGS. 5A to 5C are diagrams illustrating changes in the charged state during the full screen write process.

As described above, when a write voltage Vw higher than the surface discharge starting voltage $Vf_{xy}$ and having the same polarity as that of the auxiliary write voltage is applied to the pair of sustain electrodes, a surface discharge ES2 occurs both in the charged cell C1 and in the uncharged cell C2, as shown in FIG. 5A. If the period (pulse spacing) tb between the completion of the application of the auxiliary write voltage Vv and the application of the write voltage Vw is assumed to be 20 $\mu$s or shorter, a priming effect can be utilized for a discharge in the charged cell C1. However, the surface discharge ES2 will not occur if the period tb is extremely short. The pulse spacing tb is 10 $\mu$s to 20 $\mu$s in practice.

As a result of the surface discharge ES2, greater wall charges are accumulated in the charged and uncharged cells C1 and C2 than during the sustain period, as shown in FIG. 5B. The accumulated charges are dependent on the intensity of the surface discharge ES2.

Upon the completion of the application of the write voltage Vw, a self-discharge ES3 occurs both in the charged cell C1 and the uncharged cell C2, as shown in FIG. SC. This removes the wall charges so that the whole screen SC is brought into the uncharged state.

Figure 6:
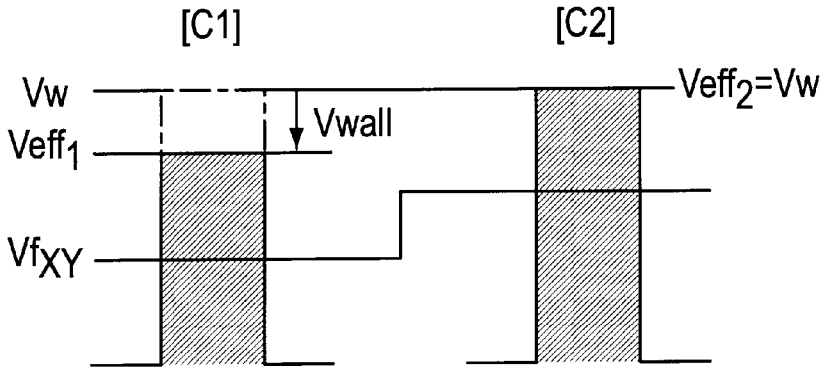
FIG. 6 is a diagram for explaining the principle of equalization of discharge intensities in the full screen write process.

FIG. 6 is a diagram for explaining the principle of equalization of discharge intensities in the full screen write process.

At the application of the write voltage Vw, the wall charges exist in the charged cell C1 (see FIG. 4C), so that an effective voltage $Veff_1$ in the charged cell C1 becomes lower than the write voltage Vw by the magnitude of a wall voltage Vwall. However, since the surface discharge starting voltage $Vf_{xy}$ is lowered by the priming effect, the difference between the effective voltage $Veff_1$ and the surface discharge starting voltage Vfxy is reduced to such a level as in the case where no wall charge exists. On the other hand, an effective voltage $Veff_2$ in the uncharged cell C2 is equal to the write voltage Vw, so that a surface discharge occurs at an intensity corresponding to the difference between the effective voltage $Veff_2$ and the surface discharge starting voltage $Vf_{xy}$.

By adjusting the auxiliary write voltage Vv for optimization of the charges and optimizing the timing of applying the write voltage Vw, the difference in the discharge intensity between the charged cell C1 and the uncharged cell C2 can be minimized.

Figure 7:
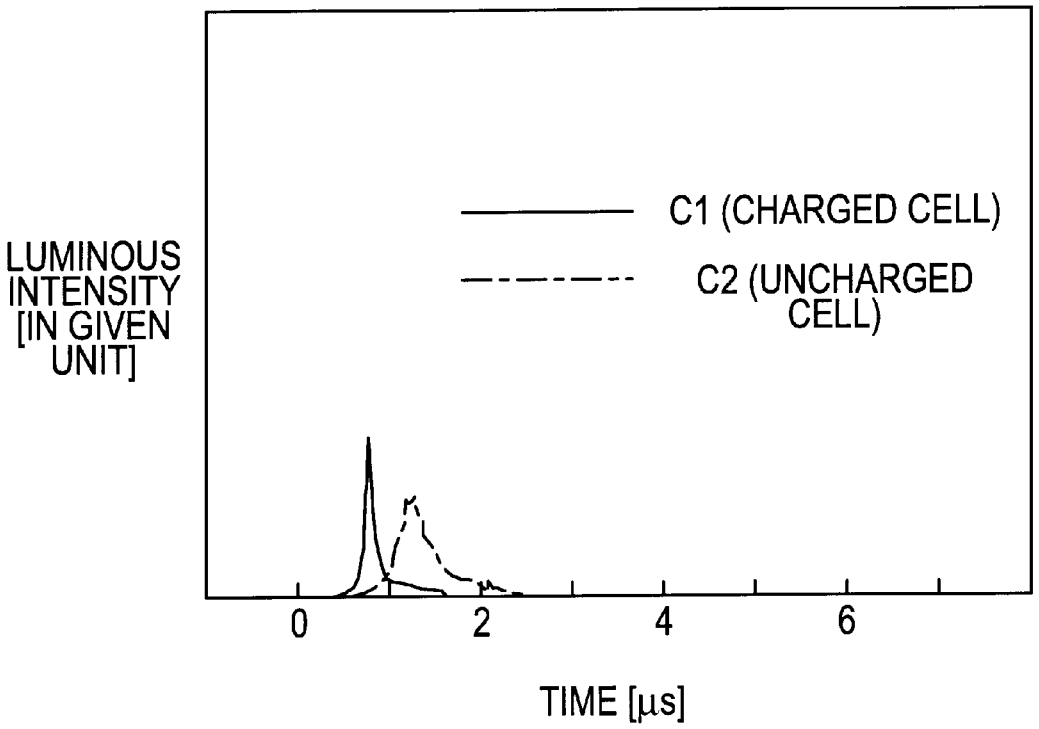
FIG. 7 is a graphical representation illustrating luminous intensities in the full screen write process.

FIG. 7 is a graphical representation illustrating luminous intensities in the full screen write process. The driving conditions in the embodiment of FIG. 7 are shown in Table 2.

Figure 10:
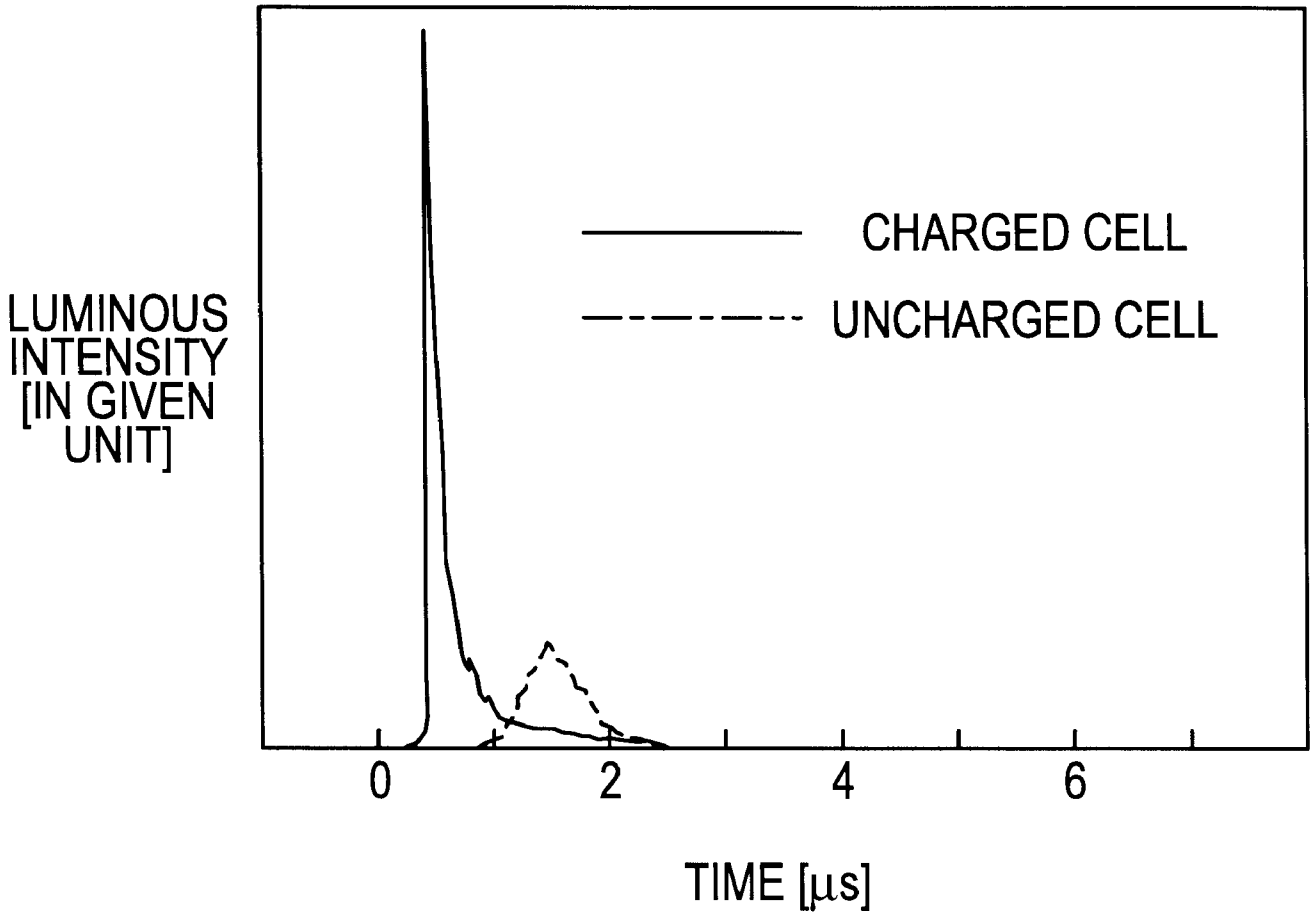
FIG. 10 (PRIOR ART)
FIG. 10 is a graphical representation illustrating a difference in the luminous intensity between a charged cell and an uncharged cell in a conventional PDP.

In FIG. 7, the peak value of the luminous intensity (solid line) of the charged cell C1 is about 1.6 times that of the luminous intensity (dashed line) of the uncharged cell C2. As is apparent from a comparison between FIGS. 7 and 10, the discharge intensities in the charged and uncharged cells C1 and C2 can be equalized.

TABLE 2

| | |
|---|---|
| Peak value Vv of auxiliary write pulse | 170 V |
| Pulse width ta of auxiliary write pulse | 3 $\mu$s |
| Pulse spacing tb | 15 $\mu$s |

Figure 8:
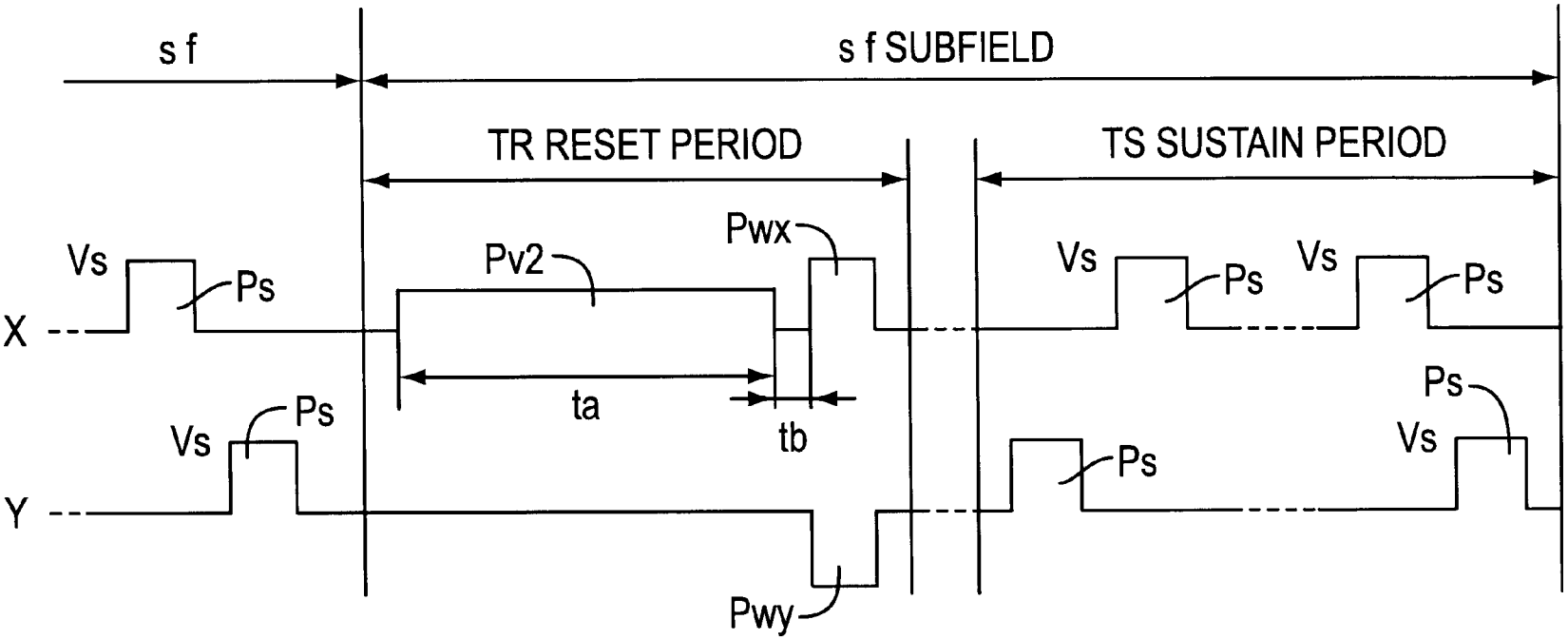
FIG. 8 is a voltage waveform chart for a driving method in accordance with a second embodiment.
Figure 9:
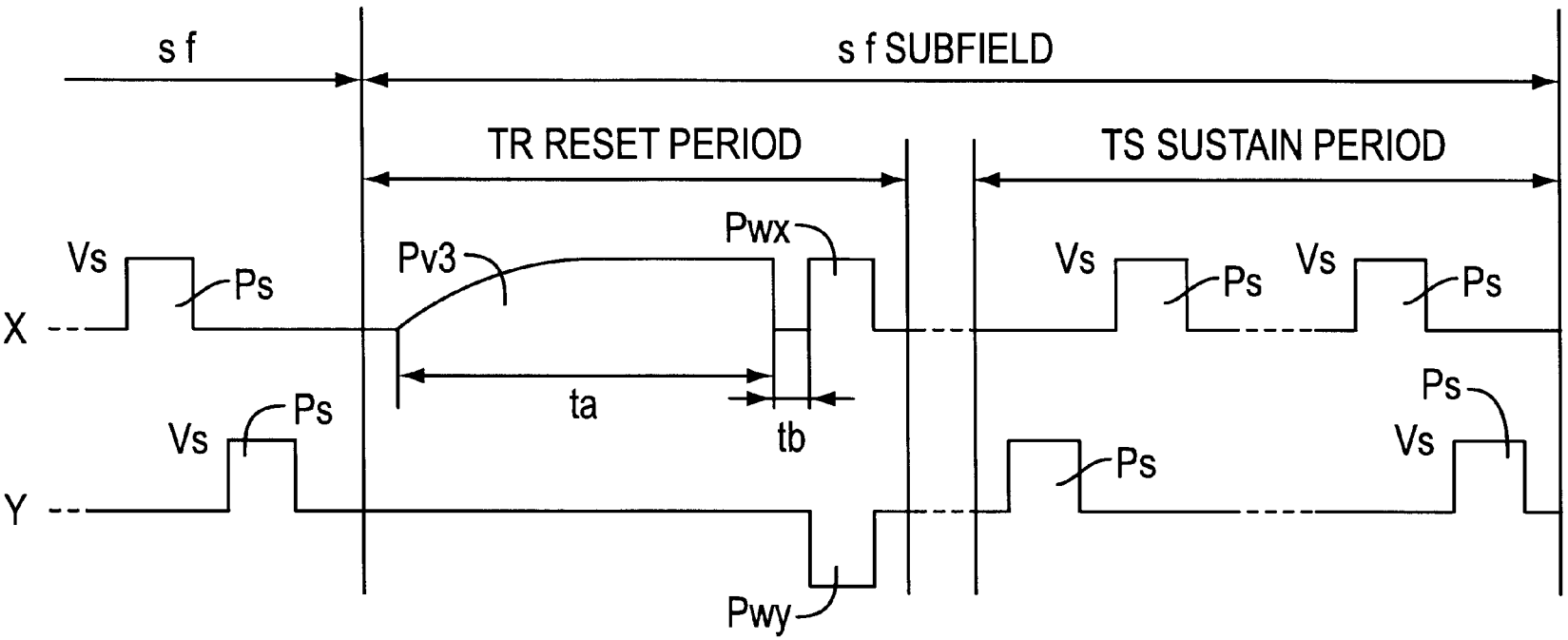
FIG. 9 is a voltage waveform chart for a driving method in accordance with a third embodiment.

FIG. 8 is a voltage waveform chart for a driving method in accordance with a second embodiment, and FIG. 9 is a voltage waveform chart for a driving method in accordance with a third embodiment, in which like pulses corresponding to those in FIG. 3 are designated by like reference numerals.

In accordance with the driving method shown in FIG. 8, a positive auxiliary write pulse Pv2 having a greater pulse width ta than that of the sustain pulse Ps is applied to the sustain electrodes X during the reset period TR prior to the full screen write process for applying the write pulses Pwx and Pwy. The peak value of the auxiliary write pulse Pv2 is adjusted to be lower than the sustain voltage Vs by about 20 V to about 50 V. With the auxiliary write pulse having a greater pulse width ta, a discharge occurs with a greater certainty than in the case where the auxiliary write pulse has a smaller pulse width. This improves the reliability of the write preparation process. The pulse width ta is 10 $\mu$s to 20 $\mu$s in practice.

In accordance with the driving method shown in FIG. 9, a positive auxiliary write pulse Pv3 having a greater width ta and a less steep rising edge than the sustain pulse Ps is applied to the sustain electrodes X during the reset period TR prior to the full screen write process for applying the write pulses Pwx and Pwy. The peak value of the auxiliary write pulse Pv3 is assumed to be the same as that of the sustain voltage Vs. With the auxiliary write pulse having a less steep rising edge, an effective voltage gradually increases to reach the discharge starting level, where a discharge occurs. Therefore, the light emission caused by the discharge is less intense than in the case where the auxiliary write pulse has a steep rising edge. Thus, the use of an auxiliary write pulse Pv having an obtuse waveform enhances the contrast with unwanted light emission suppressed. To provide such an obtuse waveform, a resistance may be interposed between the power source and the sustain electrode X. A time constant for a voltage transition is increased accordingly with the interposed resistance, so that the pulse has a less steep rising edge.

Although the driving method of the present invention is applied to the surface discharge PDP 1 in the foregoing embodiments, the present invention is also applicable to a two-electrode opposed discharge PDP in which electrodes X and Y are provided on front and rear substrates, respectively, in an intersecting relation. The driving conditions are not limited to the exemplary numeric values shown in Table 2, but may vary depending on the construction of the panel. It is not necessarily required to cause the self-discharge during the reset period TR. Where an erase address mode is employed, for example, wall charges are accumulated in each cell to such an extent that the self-discharge is not induced.

In accordance with the present invention, all cells in a PDP can be equally charged in the full screen write process, whether or not the cells have residual wall charges. This allows for high quality display free from unevenness. In addition, display in the write address mode can be controlled with improved reliability. Even with the provision of the write preparation process, the complication of the driving circuit can be avoided, since a power source for application of a sustain voltage is used for application of an auxiliary write voltage. Further, a discharge can be assuredly caused for equally changing all the cells. Furthermore, unwanted light emission can be suppressed to prevent the lowering of the contrast of the PDP.

Although the present invention has been described in detail by way of the embodiments thereof, it should be understood that the embodiments are merely illustrative of the present invention but not limitative of the same, and various modifications and changes may be made without departing from the spirit and scope of the invention as defined by the appended claims.

What is claimed is:

1. A method of driving an AC type plasma display panel including a full screen write step of applying a write voltage higher than a discharge starting voltage to respective cells constituting a screen of the plasma display panel to cause a discharge in the respective cells for accumulation of wall charges therein, the method comprising:

a write preparation step of applying an auxiliary write voltage lower than the discharge starting voltage and having the same polarity as that of the write voltage to the respective cells to cause a discharge in a charged cell having wall charges accumulated before the application of the auxiliary write voltage for inversion of the polarity of a wall voltage in the charged cell, said write preparation step being performed prior to the full screen write step, wherein the application of the write voltage in the full screen write step is performed within a period during which space charges resulting from the discharge caused in response to the application of the auxiliary write voltage remain in the charged cell, so that a priming effect of the space charges can be utilized, thereby minimizing a difference in discharge intensity between the charged cells and uncharged cells.

2. A method of driving an AC type plasma display panel comprising:

a reset step of causing a self-discharge in respective cells constituting a screen of the plasma display panel for equalization of charged states in the respective cells over the screen;

an addressing step of accumulating wall charges in a specific cell in accordance with display data;

a sustaining step of applying a sustain pulse having a peak value lower than that of a discharge starting voltage to sustain the display data; and the reset step, the addressing step and the sustaining step being repeatedly performed, wherein the reset step comprises the steps of applying an auxiliary write voltage lower than the discharge starting voltage to the respective cells to cause a discharge in a charged cell having wall charges accumulated before the application of the auxiliary write voltage for inversion of the polarity of a wall voltage in the charged cell; and applying to the respective cells a write voltage higher than the discharge starting voltage and having the same polarity as that of the auxiliary write voltage within a period during which space charges resulting from the discharge caused in response to the application of the auxiliary write voltage remain in the charged cell thereby to cause a discharge in the respective cells for accumulation of wall charges required for the self-discharge in the respective cells, so that a priming effect of the space charges can be utilized, thereby minimizing a difference in discharge intensity between the charged cells and uncharged cells.

3. A method of driving an AC type plasma display panel including a full screen write step of applying a write voltage higher than a discharge starting voltage to respective cells constituting a screen of the plasma display panel to cause a discharge in the respective cells for accumulation of wall charges therein, the method comprising:

a write preparation step of applying an auxiliary write voltage lower than the discharge starting voltage and having the same polarity as that of the write voltage to the respective cells to cause a discharge in a charged cell having wall charges accumulated before the application of the auxiliary write voltage for inversion of the polarity of a wall voltage in the charged cell, said write preparation step being performed prior to the full screen write step.

wherein the application of the write voltage in the full screen write step is performed within a period during which space charges resulting from the discharge caused in response to the application of the auxiliary write voltage remain in the charged cell, wherein a time interval between the application of the auxiliary write voltage and the application of the write voltage is 10 $\mu$s to 20 $\mu$s.

4. A method of driving an AC type plasma display panel, comprising:

a reset step of causing a self-discharge in respective cells constituting a screen of the plasma display panel for equalization of charged states in the respective cells over the screen;

an addressing step of accumulating wall charges in a specific cell in accordance with display data;

a sustaining step of applying a sustain pulse having a peak value lower than that of a discharge starting voltage to sustain the display data; and the reset step, the addressing step and the sustaining step being repeatedly performed, wherein the reset step comprises the steps of applying an auxiliary write voltage lower than the discharge starting voltage to the respective cells to cause a discharge in a charged cell having wall charges accumulated before the application of the auxiliary write voltage for inversion of the polarity of a wall voltage in the charged cell; and applying to the respective cells a write voltage higher than the discharge starting voltage and having the same polarity as that of the auxiliary write voltage within a period during which space charges resulting from the discharge caused in response to the application of the auxiliary write voltage remain in the charged cell thereby to cause a discharge in the respective cells for accumulation of wall charges required for the self-discharge in the respective cells, wherein a voltage pulse having the same peak value as that of the sustain pulse and a pulse width smaller than that of the sustain pulse is applied as the auxiliary write voltage.

5. A method of driving an AC type plasma display panel, comprising:

a reset step of causing a self-discharge in respective cells constituting a screen of the plasma display panel for equalization of charged states in the respective cells over the screen;

an addressing step of accumulating wall charges in a specific cell in accordance with display data;

a sustaining step of applying a sustain pulse having a peak value lower than that of a discharge starting voltage to sustain the display data; and the reset step, the addressing step and the sustaining step being repeatedly performed, wherein the reset step comprises the steps of applying an auxiliary write voltage lower than the discharge starting voltage to the respective cells to cause a discharge in a charged cell having wall charges accumulated before the application of the auxiliary write voltage for inversion of the polarity of a wall voltage in the charged cell; and applying to the respective cells a write voltage higher than the discharge starting voltage and having the same polarity as that of the auxiliary write voltage within a period during which space charges resulting from the discharge caused in response to the application of the auxiliary write voltage remain in the charged cell thereby to cause a discharge in the respective cells for accumulation of wall charges required for the self-discharge in the respective cells, wherein a voltage pulse having a peak value lower than that of the sustain pulse and a pulse width greater than that of the sustain pulse is applied as the auxiliary write voltage.

6. A method of driving an AC type plasma display panel, comprising:

a reset step of causing a self-discharge in respective cells constituting a screen of the plasma display panel for equalization of charged states in the respective cells over the screen;

an addressing step of accumulating wall charges in a specific cell in accordance with display data;

a sustaining step of applying a sustain pulse having a peak value lower than that of a discharge starting voltage to sustain the display data; and the reset step, the addressing step and the sustaining step being repeatedly performed, wherein the reset step comprises the steps of applying an auxiliary write voltage lower than the discharge starting voltage to the respective cells to cause a discharge in a charged cell having wall charges accumulated before the application of the auxiliary write voltage for inversion of the polarity of a wall voltage in the charged cell; and applying to the respective cells a write voltage higher than the discharge starting voltage and having the same polarity as that of the auxiliary write voltage within a period during which space charges resulting from the discharge caused in response to the application of the auxiliary write voltage remain in the charged cell thereby to cause a discharge in the respective cells for accumulation of wall charges required for the self-discharge in the respective cells, wherein a voltage pulse having a pulse width greater than that of the sustain pulse and an obtuse waveform having a less steep rising edge is applied as the auxiliary write voltage.

7. A method of driving a plasma display panel, comprising applying a write voltage higher than a discharge starting voltage to respective cells constituting a screen of the plasma display panel, causing a discharge in the respective cells for accumulation of wall charges therein; and applying an auxiliary write voltage lower than the discharge starting voltage and having the same polarity as that of the write voltage to the respective cells before applying the write voltage causing a discharge in charged respective cells having wall charges accumulated before the application of the auxiliary write voltage for inversion of the polarity of a wall voltage in the charged respective cells, wherein the application of the write voltage is performed within a period during which space charges resulting from the discharge caused in response to the application of the auxiliary write voltage remain in the charged cell.

8. A method of driving an AC type plasma display panel comprising:

a reset step of causing a self-discharge in respective cells constituting a screen of the plasma display panel for equalization of charged states in the respective cells over the screen;

an addressing step of accumulating wall charges in a specific cell in accordance with display data;

a sustaining step of applying a sustain pulse having a peak value lower than that of a discharge starting voltage to sustain the display data; and the reset step, the addressing step and the sustaining step being repeatedly performed, wherein the reset step comprises the steps of applying an auxiliary write voltage lower than the discharge starting voltage to the respective cells to cause a discharge in a charged cell having wall charges accumulated before the application of the auxiliary write voltage for inversion of the polarity of a wall voltage in the charged cell; and applying to the respective cells a write voltage higher than the discharge starting voltage and having the same polarity as that of the auxiliary write voltage within a period during which space charges resulting from the discharge caused in response to the application of the auxiliary write voltage remain in the charged cell thereby to cause a discharge in the respective cells for accumulation of wall charges required for the self-discharge in the respective cells, wherein a time interval between the application of the auxiliary write voltage and the application of the write voltage is 10 $\mu$s to 20 $\mu$s.

* * * * *